US011528554B2

(12) United States Patent
Pelvan et al.

(10) Patent No.: US 11,528,554 B2
(45) Date of Patent: Dec. 13, 2022

(54) NEAR-FIELD RENDERING OF IMMERSIVE AUDIO CONTENT IN PORTABLE COMPUTERS AND DEVICES

(71) Applicant: Dolby Laboratories Licensing Corporation, San Francisco, CA (US)

(72) Inventors: Ilker Deniz Pelvan, San Diego, CA (US); C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 270 days.

(21) Appl. No.: 16/088,051

(22) PCT Filed: Mar. 24, 2017

(86) PCT No.: PCT/US2017/024126
§ 371 (c)(1),
(2) Date: Sep. 24, 2018

(87) PCT Pub. No.: WO2017/165837
PCT Pub. Date: Sep. 28, 2017

(65) Prior Publication Data

US 2020/0304906 A1 Sep. 24, 2020

Related U.S. Application Data

(60) Provisional application No. 62/474,194, filed on Mar. 21, 2017, provisional application No. 62/312,839, filed on Mar. 24, 2016.

(51) Int. Cl.
*H04R 1/32* (2006.01)
*H04R 5/02* (2006.01)

(52) U.S. Cl.
CPC ..... *H04R 1/323* (2013.01); *H04R 5/02* (2013.01)

(58) Field of Classification Search
CPC ... H04R 1/20; H04R 1/22; H04R 1/24; H04R 1/26; H04R 1/32; H04R 1/323;
(Continued)

(56) References Cited

U.S. PATENT DOCUMENTS 5,222,145 A 6/1993 Draffen
5,668,882 A * 9/1997 Hickman ..... G06F 1/1616 381/182
(Continued)

FOREIGN PATENT DOCUMENTS

CN 104604256 5/2015
CN 105075295 11/2015
(Continued)

OTHER PUBLICATIONS

Optimal Sound, APO (https://web.archive.Org/web/20150504113707/http://optimalsound.com/licensing.html) (archived by the WayBackMachine May 4, 2015) (Year: 2015).*
(Continued)

*Primary Examiner* — Walter F Briney, III

(57) ABSTRACT

Embodiments for a speaker system that produces a near-field sound pattern for rendering immersive audio content in a portable device. An array of drivers projects sound upwards from a top surface of the portable device to form upward-firing speakers; a set of speakers projects sound downwards from a bottom surface of the portable device to form downward-firing speakers. A decoder/renderer component receives immersive audio content, decodes height audio signals from the content and sends direct audio signals to the downward-firing speakers. A crossover performs a high-pass filter function to pass high frequency components of the decoded height audio signals to the upward-firing speakers and low frequency components of the decoded height audio signals to the downward-firing speakers.

14 Claims, 9 Drawing Sheets

(58) Field of Classification Search
CPC ... H04R 3/12; H04R 3/14; H04R 5/02; H04R 5/04; H04R 2201/40; H04R 2201/401; H04R 2201/403; H04R 2201/405; H04R 2205/00; H04R 2205/022; H04R 2205/024; H04R 2499/10; H04R 2499/11; H04R 2499/13; H04R 2499/15; H04S 1/00; H04S 1/002; H04S 1/007; H04S 3/00; H04S 3/002; H04S 3/008; H04S 5/00; H04S 5/005; H04S 5/02; H04S 2400/00; H04S 2400/01; H04S 2400/07
See application file for complete search history.

(56) References Cited

U.S. PATENT DOCUMENTS

| | | | | |
|---|---|---|---|---|
| 6,118,876 | A | 9/2000 | Ruzicka | |
| 6,243,260 | B1 * | 6/2001 | Lundgren | G06F 1/1616 361/679.23 |
| 6,359,994 | B1 * | 3/2002 | Markow | G06F 1/1616 361/679.41 |
| 6,925,186 | B2 | 8/2005 | Bacon | |
| 8,363,865 | B1 | 1/2013 | Bottum | |
| 8,447,055 | B2 | 5/2013 | Jankovsky | |
| 9,179,236 | B2 | 11/2015 | Robinson | |
| 2003/0058611 | A1 * | 3/2003 | An | G06F 1/1616 361/679.55 |
| 2007/0003097 | A1 | 1/2007 | Langberg | |
| 2012/0170759 | A1 | 7/2012 | Yuen | |
| 2012/0288124 | A1 * | 11/2012 | Fejzo | H04R 5/02 381/303 |
| 2015/0036869 | A1 * | 2/2015 | Youn | H04R 1/323 381/412 |
| 2015/0223002 | A1 * | 8/2015 | Mehta | H04S 7/30 381/303 |
| 2015/0304791 | A1 * | 10/2015 | Crockett | H04S 7/307 381/307 |
| 2017/0070837 | A1 * | 3/2017 | De Poortere | H04S 7/302 |
| 2017/0220283 | A1 * | 8/2017 | Zhang | H04N 19/423 |

FOREIGN PATENT DOCUMENTS

| | | | | |
|---|---|---|---|---|
| CN | 105340300 | | 2/2016 | |
| CN | 105376691 | | 3/2016 | |
| WO | 1998/054926 | | 12/1998 | |
| WO | WO-2009140794 | A1 * | 11/2009 | H04S 3/008 |
| WO | 2014/107714 | | 7/2014 | |
| WO | WO-2014107714 | A1 * | 7/2014 | H04R 5/02 |

OTHER PUBLICATIONS

Dell XPS 15Z Notebook Review Dell XPS 15z notebook review http://hexus.net/tech/reviews/laptop/31032-dell-xps-15z-notebook-review/?page=2.

* cited by examiner

NEAR-FIELD RENDERING OF IMMERSIVE AUDIO CONTENT IN PORTABLE COMPUTERS AND DEVICES

FIELD OF THE INVENTION

One or more implementations relate generally to speaker systems for portable devices, and more specifically to portable computer devices rendering immersive audio content.

BACKGROUND

The competitive portable (laptop or notebook) personal computer (PC) market forces manufacturers to offer features that significantly differentiate their products from their competitors. One prime feature for distinction is to provide high quality audio playback as these devices are increasingly used to playback sophisticated content, such as streaming audio/video (AV) programs, realistic simulations, advanced games, 3D/virtual reality applications, and so on. However, PCs, tablet computers, smartphones and similar devices are becoming ever smaller, lighter, and thinner thus imposing severe packaging constraints on manufacturers As is well known, good audio playback requires size, volume and power to allow speakers to project loudly and clearly, and present packaging and cost constraints increasingly limit the sound quality possible for playback through small, low-powered speakers.

The advent of object and immersive audio in which channel-based audio is augmented with a spatial presentation of sound that utilizes audio objects (audio signals with associated parametric descriptions of apparent 3D position, width, and other parameters) has allowed the rendering of very realistic audio content Immersive audio, such as exemplified by the Dolby Atmos™ format, may be used for many multimedia applications such as movies, video games, and simulators that are increasingly being played back on portable devices. Such content was originally developed for the cinema environment and has recently been adapted to home cinema systems, and generally requires the use of height speakers positioned above the listener, such as in the ceiling or high wall area, or through the use of reflective speakers that project sound upward for reflection back down to the listener. As can be appreciated, such systems thus require the use of relatively sizeable speakers that are specially configured and installed in a listening environment to provide an accurate representation of sounds around and above the listener as represented at least in part by height cues in the audio content. For portable computers that rely on internal speakers for their sound, such height cues cannot be reproduced in present device designs.

Thus, immersive audio playback systems are optimized for use with specific (e.g., ceiling) speakers to project the height sound components from above a listener's head. Special speaker designs have been developed to allow relatively easy mounting in high locations, but this obviously adds a great deal of complexity and cost in laying out immersive audio speaker systems. Dolby Atmos Home Theater systems have solved this problem for home entertainment use cases by integrating speakers that are angled towards the ceiling and render Dolby Atmos height information by reflecting the audio waves off of the ceiling of the room towards the listener. However, this method requires speakers that are too large and powerful to fit inside a laptop computer or other portable device, as well as requiring positioning the speakers at correct angles with respect to the listener and the ceiling. This, naturally, requires more space inside the laptop housing, and the speakers need to be powerful enough to create audio waves with enough energy to reflect off of the ceiling and hit the listener position with still enough energy to create the height aspect. Present laptop computers and similar portable devices typically have only one or two speakers that are located at the bottom of the laptop shell (the part that holds the keyboard and electronics), and fire downwards toward the surface of the table. Such speakers are totally inadequate for playback of audio content that contains height or other directional cues.

What is needed, therefore, is a speaker system for portable devices and laptop (notebook) form factor computers that are small but powerful enough to fit inside a laptop housing, and can playback height cues in immersive audio content without needing to reflect audio waves off of the ceiling.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to a speaker system for a portable device having an array of drivers projecting sound upwards from a top surface of the portable device to form upward-firing speakers, a set of speakers projecting sound downwards from a bottom surface of the portable device to form downward-firing speakers, a decoder/renderer component receiving immersive audio content, decoding height audio signals from the content and sending direct audio signals to the downward-firing speakers, and a crossover performing a high-pass filter function to pass high frequency components of the decoded height audio signals to the upward-firing speakers and low frequency components of the decoded height audio signals to the downward-firing speakers. In an embodiment, the sound is projected in a sound pattern directed 90 degrees up from a surface upon which the portable device is placed. The array of drivers may be one of: a pair of stereo drivers or a set of four equidistantly spaced drivers, and wherein the set of downward-firing speakers comprises a low frequency effect (LFE) driver and at least two stereo drivers.

Each driver of the array of drivers may be transducer of approximately 15 mm to 20 mm in diameter and 4 mm to 6 mm thickness placed into an enclosure of approximately 3 cc to 4 cc in volume. The threshold frequency of the crossover may be on the order of 2 kHz. The portable device may be one of a laptop computer, tablet computer, game console, smart phone, and portable audio playback device. The decoder/renderer component may be provided as part of a software package interfacing with an operating system of the device. The immersive audio content comprises channel-based audio and object-based audio including sound objects having height components.

Embodiments are also directed to a method of creating a near-field sound environment for playback of immersive audio content through a portable device, by: receiving immersive audio content, decoding the received immersive audio content to separate direct audio from height audio to generate appropriate direct and height speaker feeds, transmitting the direct audio to direct speakers of the portable device through the direct speaker feeds, and high-pass filtering the height audio to pass high frequencies of the height audio to the height speakers of the portable device through the height speaker feeds and pass low frequencies of the height audio to the direct speakers through the direct speaker feeds. The low frequencies and high frequencies of the height audio are defined by a threshold frequency set by a crossover circuit that is on the order of between 1 kHz and 5 kHz.

In the method, the direct speakers may comprise speakers located on a bottom surface of the portable device and configured to project sound downwards from the bottom surface, and the height speakers comprise speakers located on an upper surface of the portable device and configured to project sound upwards and substantially upwards in front of a user of the portable device in a soundfield approximately two feet around the portable device. The direct speaker feeds may comprise left, right, and LFE channel feeds, and the height speaker feeds comprise right and left height channels, wherein each height channel drives at least one or a pair of individual upward-firing drivers of a speaker array. The method may further comprise processing the direct and height audio in a device processing stage performing at least one of equalization, filtering, and shaping of the immersive audio content. The method may yet further comprise detecting the presence of one or more external speakers for playback of the height audio, and transmitting the height speaker feeds to the detected external speakers.

Embodiments are yet further directed to methods of making and using or deploying the speakers, circuits, and transducer designs that optimize the rendering and playback of reflected sound content using a frequency transfer function that filters direct sound components from height sound components in an audio playback system.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
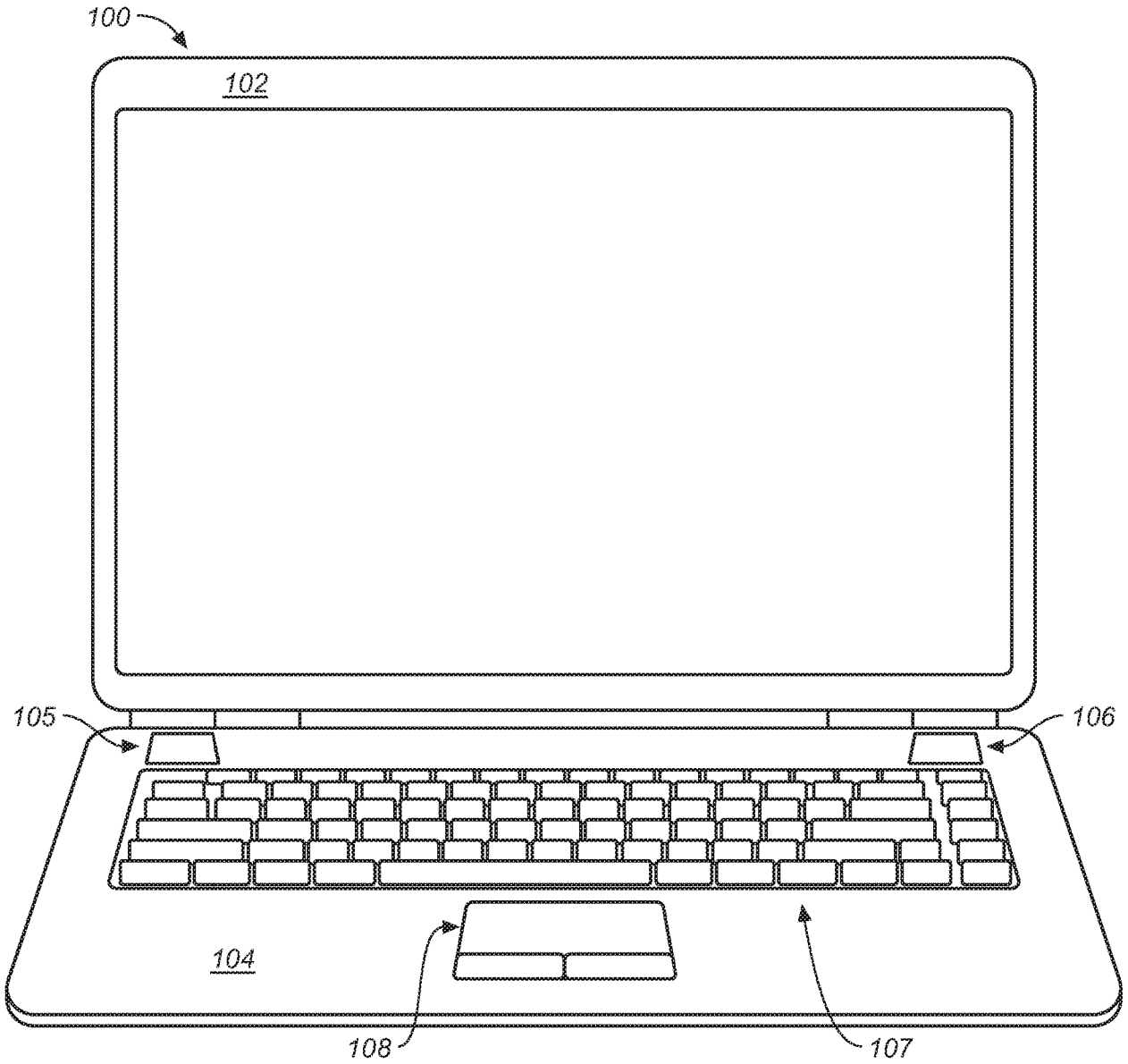
FIG. 1 illustrates an example portable device that contains an array of upward-firing speakers that creates a near-field audio pattern to reproduce immersive audio content under some embodiments.

Systems and methods are described for speakers in a portable device, such as a laptop computer or tablet that creates a near field audio experience for playback of immersive audio content without requiring sound reflection or special speaker placement. Aspects of the one or more embodiments described herein may be implemented in or used in conjunction with an audio or audio-visual (AV) system that processes source audio information in a mixing, rendering and playback system that includes one or more computers or processing devices executing software instructions.

Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on (i.e., a collection of channels as just defined); the term "object" means one or more audio channels with a parametric source description, such as apparent source position (e.g., 3D coordinates), apparent source width, etc.; "object-based audio" means a collection of objects as just defined; and "immersive audio," (alternatively "spatial audio") means channel-based and object or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content. The term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers. The terms "driver" and "speaker" may be used interchangeably when referring to a single-driver speaker. The terms "speaker feed" or "speaker feeds" may mean an audio signal sent from an audio renderer to a speaker for sound playback through one or more drivers.

Embodiments are directed to a reflected sound rendering system that is configured to work with a sound format and processing system that may be referred to as an "immersive audio system," or "spatial audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio and object-based audio. Such a combined approach provides greater coding efficiency and rendering flexibility compared to either channel-based or object-based approaches taken separately. An example of an immersive audio system that may be used in conjunction with present embodiments is described in U.S. Provisional Patent Application 61/636,429, filed on Apr. 20, 2012 and entitled "System and Method for Adaptive Audio Signal Generation, Coding and Rendering."

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined channel. In an immersive audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

Portable Computer Speaker System

As described above, accurate playback of immersive content in portable devices such as laptop/notebook computers is not presently possible because of speaker placement and audio processing constraints. Embodiments of a portable device speaker system overcomes this problem by integrating by configuring speakers to directly fire upwards at a substantially 90-degree angle from the surface of the table (referred to as upward-firing speakers), thus creating a sound field that can reproduce a similar height effect as can be produced by direct or reflected speakers (e.g., as in Dolby Atmos Home Theater systems) for the listener in a near-field environment that is around the portable computer itself. The system includes specific immersive audio processor and software library to apply post-processing technology that allows the correct filtering of the height information to send only high-frequency content in the height-related channels to the upward-firing speakers (such as by using a standard high-pass filter) and the rest of the content to the downward-firing speakers. This allows the use of speakers small enough to fit within the laptop form factor.

For purposes of illustration and explanation, embodiments are primarily described and shown with respect to a laptop or notebook computer. It should be noted, however, that the speaker system described herein can be applied to many different types of portable devices of various form factors, including but not limited to: smartphones, portable game consoles, handheld computing devices, tablets, and so on. Thus, for brevity, embodiments may be described with respect to a portable device embodied in a two-piece (lid plus body) portable computer, but embodiments are not so limited.

In an embodiment, an array of two or more height channel speakers is positioned on an upper surface of a laptop computer or tablet device to project sound upward relative to a user, while the non-height or standard speakers may be located on other surfaces of the device, and typically in the bottom surface of the computer. As shown in FIG. 1, portable device 100 represented as a laptop or notebook computer 100 includes a body 104 that contains a keyboard 107 and trackpad 108 and generally houses the circuit boards, batteries, and other main components of the computer. A lid portion 102 houses the display and is attached to the body 104 by hinges. For the embodiment of FIG. 1, two upward facing speakers 105 and 106 are positioned in a portion of the body 104 near the lid 102 and are mounted just under or flush with surface 104. These speakers are positioned and configured to project sound upward and substantially parallel to the lid 102 when it is opened at 90 degrees relative to the body 104. Speakers 105 and 106 are provided in addition to any native speakers present in device 100. For example, in one or more internal speakers may be provided to project sound from the sides or bottom of the body 104.

Figure 2:
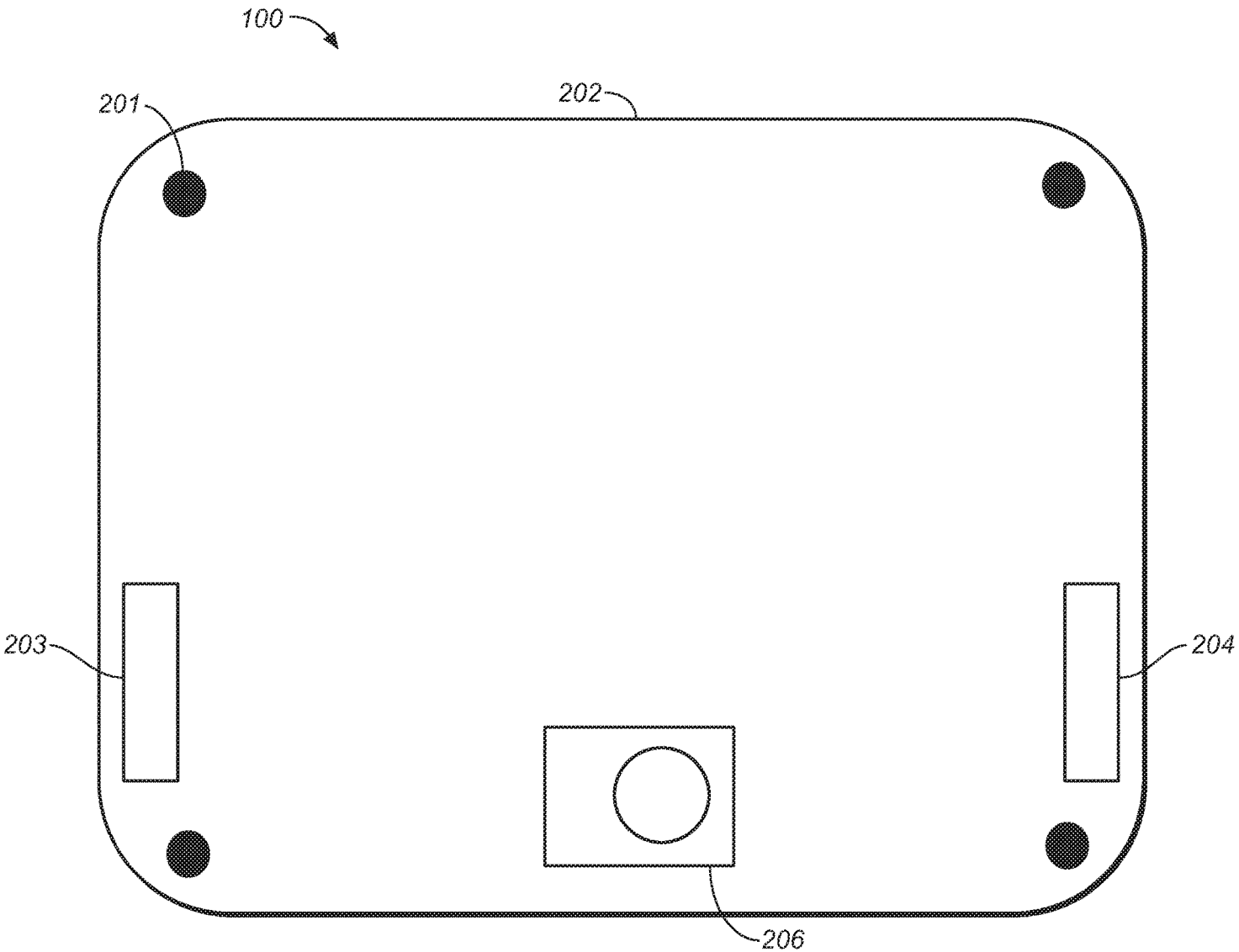
FIG. 2 illustrates a bottom surface or underside of the portable device of FIG. 1, under some embodiments.

FIG. 2 illustrates a bottom surface or underside of the portable device 100 of FIG. 1 with one or more built-in speakers installed. For the example embodiment of FIG. 2, surface 202 represents the underside of body 104 with a set of rubber bumpers or bushings 201 that protect the bottom of the when placed on a table or other surface and provide some amount of gap between the table and the bottom surface 202. This gap allows speakers to project sound out from under the device. As shown in FIG. 2, speakers 203 and 204 represent two stereo speakers that are included with the device for regular audio playback. As configured from the manufacturer, such speakers are typically hooked up to playback all of the audio generated by the device, such as playback or program content and startup/shutdown chimes, alarms, notifications, and so on. As such, they typically function as full range speakers for playback over the entire 0-20 kHz range, or as close as possible given size and power constraints. An optional low-frequency effects (LFE) speaker 206 may also be provided if enough power and packaging room is available in the body of the device. Such a speaker is generally configured to playback low-frequency sounds (e.g., below 2 kHz) and may be fed by a crossover filter and low-pass speaker feed.

The underside speakers 203 and 204 represent the direct playback channels for surround-sound or immersive audio content, and the LFE speaker 206 represents the standard surround LFE channel, while the upward-firing speakers 105 and 106 represent the height channels. For purposes of description, it is appropriate to refer to this portable device speaker system in the same manner as Dolby Atmos or similar home theater systems, where the speakers are referred to as: X.Y.Z (e.g. 5.1.4, or 7.1.2) and X denotes the number of direct channel speakers, Y denotes the number of LFE or subwoofer speakers, and Z denotes the number of height speakers. For the embodiment of FIGS. 1 and 2, the direct firing speakers are the downward-firing speakers 203 and 204 and the height speakers are the upward-firing speakers 105 and 106, while speaker 206 is the LFE speaker. Thus, the example device 100 of FIGS. 1 and 2 can be denoted as a 2.1.2 configuration.

Figure 3:
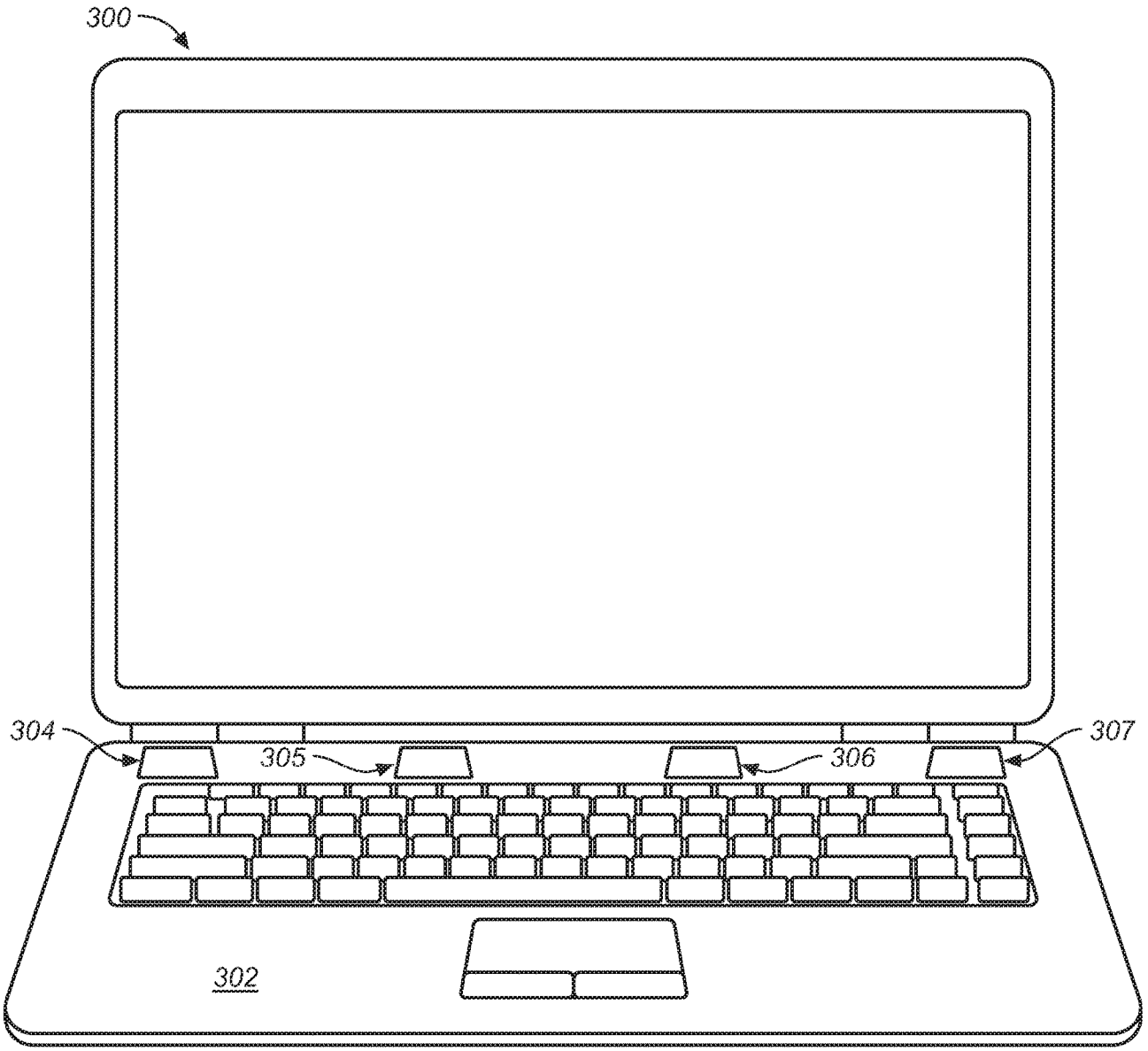
FIG. 3 illustrates the portable device of FIG. 2 with an alternate array of upward-firing speakers under some embodiments.
Figure 4:
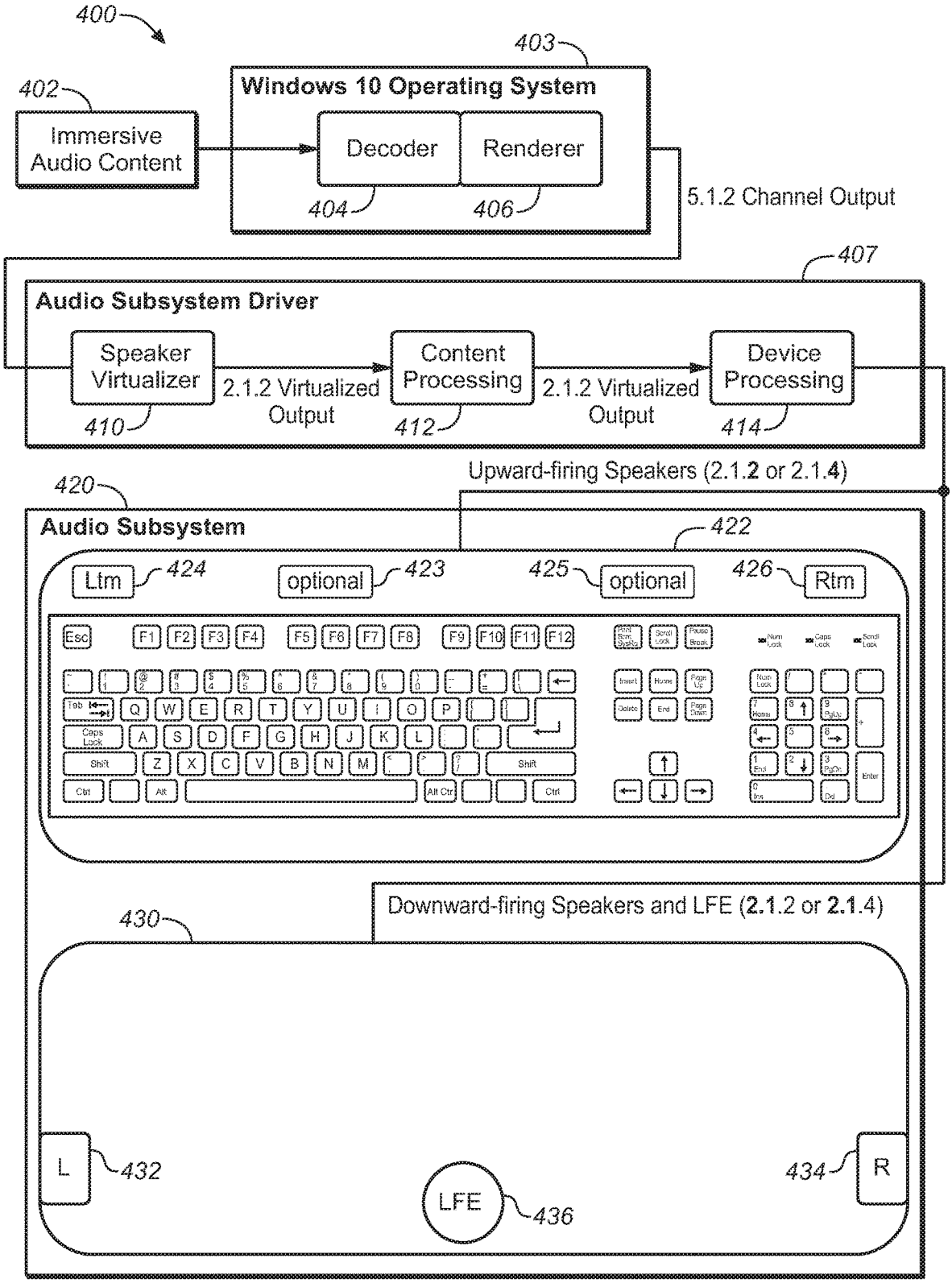
FIG. 4 is a block diagram illustrating hardware and software components of an upward-firing speaker system for portable devices and immersive audio content, under some embodiments.

Any practical number of speakers may be provided for each component of the immersive audio to be rendered, though numbers are typically low for small-scale portable devices. For example, the number of LFE speakers is typically just one, but two to four direct channels speakers may be provided in the underside of the device. Similarly, the array of upward-firing speakers may be a pair of speakers as shown in FIG. 1, or it may be 4 or more speakers, if practical. FIG. 3 illustrates a portable device under an alternative embodiment in which the array of upward-firing speakers comprises four speakers. For this embodiment, device 300 includes four speakers 304, 305, 306, and 308 arranged along an upper portion of body surface 302 in a horizontal array in which each of the speakers are placed equidistant from their neighbors. FIG. 4 illustrates one example embodiment of a multi-speaker array and other configurations are also possible, such as four or more speakers as practically possible depending on speaker size, device size, power, cost parameters, and so on. For the embodiment of FIG. 2, the configuration may be referred to as a 2.1.4 arrangement. If four direct firing speakers on the bottom side of the device are provided, then this would be a 4.1.4 arrangement, and so on.

For the example embodiments of FIGS. 1 and 3, the upward-firing speakers are shown in a portion of body surface 104 as being between the keyboard and lid/display, which may be referred to as the top or upper part of the body surface. Alternatively, the speakers may be placed on the lower part of the body surface, such as on either side of the trackpad 108. However, because this area is often used as a hand rest, and because upward-firing cues are better reproduced when the sound is closer to the display screen, a preferred placement is typically on the upper part as shown in FIG. 1. Alternatively, in a multi-speaker upward-firing array some of the upper-firing speakers may be placed on the upper part of the surface and others in the lower part of the body if space is limited and/or certain imaging characteristics of the height components is desired to be achieved.

The upward-firing speaker array is intended to play Dolby Atmos or other immersive audio content on PC laptop form factors and other portable devices as close as possible to the real intention of the content creator by creating a sound field that simulates the height information above and around the laptop by utilizing the upward-firing speakers and special post-processing software. Accordingly, embodiments of the system include the integration of both a hardware component in the form of specially designed and integrated speakers in the PC laptop housing, and a software component in the form of a new immersive audio processor and software/firmware library that will recreate the height content optimized for these speakers.

With respect to the hardware aspect, the upward-firing speaker array comprises two or more speakers located on the upper surface of the device body. These speakers are generally small-diameter speakers that are fitted inside specially-designed enclosures into the audio subsystem of the PC laptop or device. In an embodiment, the speakers feature a 15 to 20 mm-diameter transducer with a maximum 4 mm to 6 mm thickness to fit into the laptop body. Other sizes and dimensions may also be used depending on the size and shape of the device, but for a standard 12 inch to 15 inch laptop computer, the above dimensions are generally preferable, though embodiments are not so limited.

The transducers are generally chosen to have good SPL (sound pressure level) and performance from approximately 2 KHz to 20 kHz. In an embodiment, the speaker enclosure should be designed with about 3 to 4 cc volume. The speaker should be integrated on the rim above the keyboard area of the laptop housing, and spaced as far apart from each other as possible, such as on either side of the body as shown in FIG. 1. The opening of the transducer (i.e., the diaphragm) should be placed to be as perpendicular as possible to the surface of the table or resting surface. As shown in FIG. 3, more than two upward-firing speakers may be provided. In an embodiment, such a multi-speaker array should comprise pairs of speakers, and thus include an even number of speakers, i.e., 2, 4, 6, and so on. The number, placement and configuration of the individual speakers and speaker arrays may be different and tailored to each different make/model of PC laptop. Likewise, speaker configuration and placement may vary depending on the portable device that is used, such as tablet computer, game console, sub-miniature computer, and so on.

With regard to the software aspect, certain additional program components may be provided for use with existing immersive audio content processors, such as the Dolby Atmos system. Thus, for example, software components may include programs, plug-ins or libraries that are built on top of existing Dolby Atmos technologies to optimize the audio content for playback on the exact audio hardware that is built on the specific PC laptop.

FIG. 4 is a block diagram illustrating hardware and software components of an upward-firing speaker system for portable devices and immersive audio content, under some embodiments. As shown in diagram 400, immersive audio content 402 comprising object-based audio (and surround-sound audio) with height components rendered through decoding appropriate height cues is input into an operating system (OS) environment 403 of the portable device, which may be a laptop computer 100 or similar device. The OS environment 403 contains a decoder component 404 and a renderer component 406. In an embodiment, the software stack is built on a Windows 10 Operating System that may be installed on the PC laptop. However, any other appropriate operating system is possible, such as Microsoft Windows (any version), Apple OS, Linux, and so on. In addition, for portable mobile devices capable of audio playback, mobile or portable operating systems may be used, such as Android, Apple iOS, and so on.

In an example embodiment, the immersive audio content comprises Dolby Atmos content encoded in Dolby Digital Plus/Joint Object Coding format (referred to as DD+/JOC or generically as "immersive audio content") that is transmitted to the laptop either over an IP network (as in streaming content) or via BluRay playback. Embodiments are not so limited, however, and other standards and transmission formats are also possible. For the example embodiment shown, the DD+/JOC content is decoded and rendered in a standard fashion (e.g., as 7.1.4 or 5.1.2 channel Atmos format) with a decoder block 404 that is integrated as a Media Foundation Transform, and which is provided by Microsoft on all Windows 10 OS installations. A special immersive audio content post-processing block is then implemented as a Stream Effect Audio Processing Object (referred to as SFX APO) as part of the audio subsystem driver 407.

In an embodiment, the audio subsystem driver 407 comprises certain discrete software components including speaker virtualizer 410, content processing block 412, and device processing block 414. The speaker virtualizer 410 takes the immersive audio content in the appropriate format (e.g., Atmos 5.1.2) from the renderer 406. It then outputs this audio as channel output for the upward, downward, and LFE speakers of the portable device, such as 2.1.2. format as shown in FIG. 4. The speaker virtualizer 410 basically virtualizes the decoded DD+/JOC content to the correct speaker configuration (i.e. 7.1.4 DD+/JOC content to 2.1.4 speaker system or 5.1.2 DD+/JOC content to 2.1.2 speaker system) using standard Dolby Atmos speaker virtualization methods.

The content processing block 412 then performs certain processing steps, including performing a cross-over high-pass filter operation on the height channels (denoted as the "0.2" in the 2.1.2 system above) to extract all high-frequency content, specified by a cutoff frequency, out of the height channels and physically route them to the upward-firing speakers in the system, which in the 2.1.2 system case are the two upward-firing drivers 105 and 106. The low-frequency content remaining in the height-channels that are below the cutoff frequency, will then sent to the downward-firing drivers (in the 2.1.2 system case, the two downward-firing transducers) equally. Thus, for a 2.1.2 system, the remaining low-frequency left height channel content will be distributed to the single left downward-firing driver, or equally between any number of left downward-firing drivers; and the same for the right height channel content.

The content processor component 412 thus includes a crossover process or sub-component. The exact cutoff frequency of this crossover defines the high/low pass filter frequency for the height channels to be sent to either the upward or downward-firing drivers. This cutoff frequency may be set, through well-known crossover techniques, to any appropriate frequency, typically in the range of 1 kHz to 5 kHz as determined by the actual performance and physical characteristics of the upward-firing drivers relative to the downward-firing drivers. In an example embodiment, cutoff frequency for a laptop computer with upward-firing drivers as configured with the specifications mentioned above is 2 KHz.

A primary component of the software stack is the crossover filter step that distributes the height channel content in the original immersive audio (DD+/JOC) file among the upward and downward-firing transducers, with respect to their directions and performance capabilities. This process simulates a sound field above and around the PC laptop in the near-field for a user sitting at a normal distance and posture from the laptop. In typical usage, the near-field distance is an area within two feet of the laptop computer body.

For the embodiment of FIG. 4, a device post-processing block 414 is integrated as an Endpoint Effect Audio Processing Object (referred to as EFX APO) as part of the audio subsystem driver 407. This component performs standard audio optimization and regulation for all of the individual drivers and transducers in the audio subsystem 420. To perform this function, component 414 may include certain equalization (EQ), filtering, high/low pass functions, and other similar audio processing functions. Thus, as shown in FIG. 4, the 2.1.2 (or 2.1.4) immersive audio content for the laptop computer encompassing the audio subsystem 420 is input to the various drivers of the computer. The upper surface 422 of the computer body houses two upward-firing drivers 424 and 426 denoted Ltm (left) and Rtm (right) for playback of the left and right height channels. These drivers are used for the 2.1.2 configuration. Optionally, additional drivers 423 and 425 may be provided for the 2.1.4 configuration. Additional speakers may be provided for any practical number (2.1.x) of upward-firing drivers. The downward-firing and LFE drivers are provided on the underside 430 of the computer and comprise the left driver 432, the right driver 434, and the LFE speaker 436.

FIG. 4 illustrates a use configuration for a portable device having integrated upward-firing drivers under an embodiment. Component 406 generally represents an immersive audio component that is generally referred to as a "renderer." Such a renderer may include or be coupled to a codec decoder that receives audio signals from a source, decodes the signals and transmits them to an output stage that generates speaker feeds to be transmitted to individual speakers in the room. As stated previously, in an immersive audio system, the channels are sent directly to their associated speakers or down-mixed to an existing speaker set, and audio objects are rendered by the decoder in a flexible manner Thus, the rendering function may include aspects of audio decoding, and unless stated otherwise, the terms "renderer" and "decoder" may both be used to refer to an immersive audio renderer/decoder 404/406, such as shown in FIG. 4, and in general, the term "renderer" refers to a component that transmits speaker feeds to the speakers, which may or may not have been decoded upstream.

Figure 5:
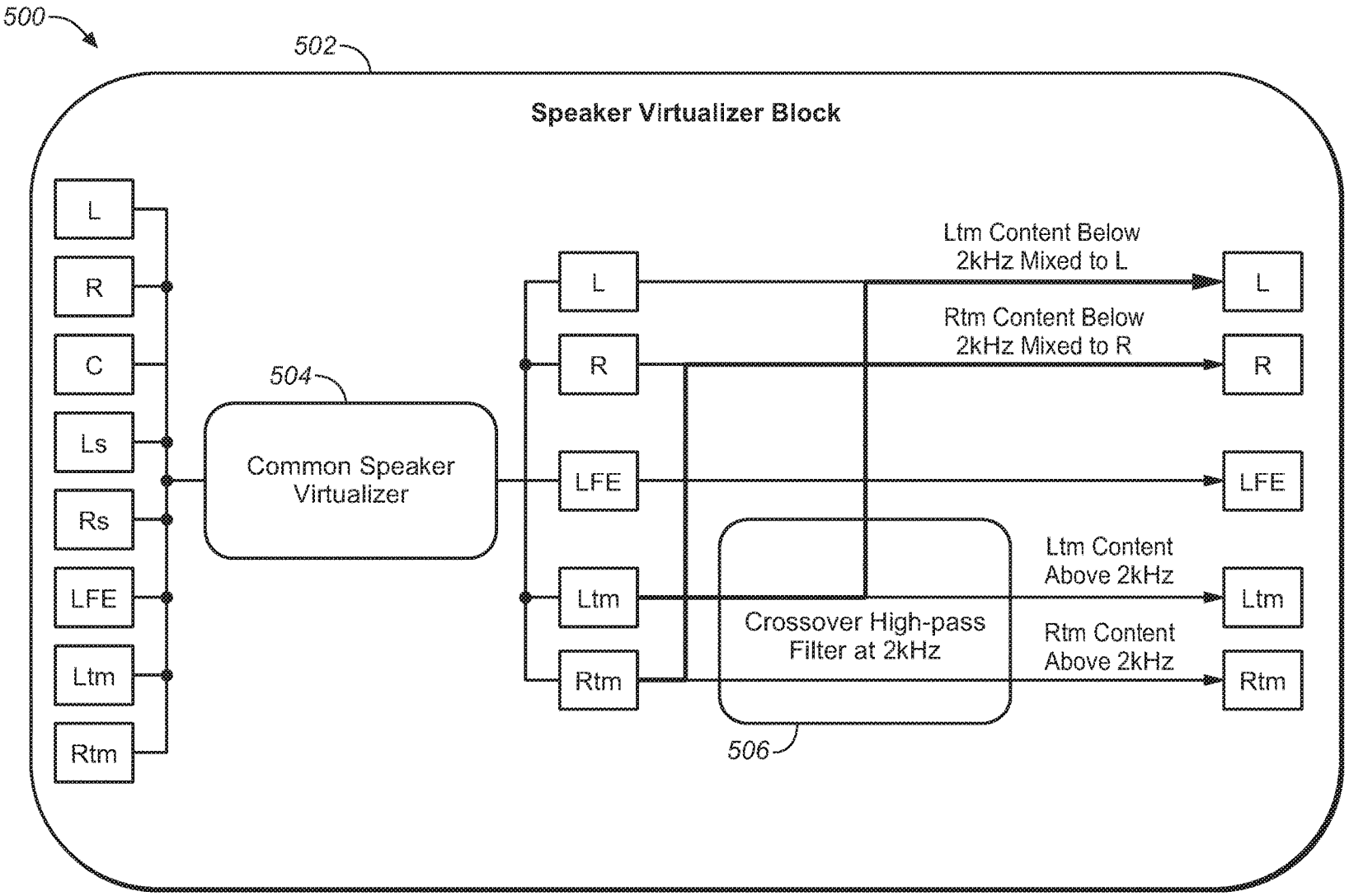
FIG. 5 is a more detailed block diagram illustrating components of the speaker virtualizer block of FIG. 4 under some embodiments.

FIG. 5 is a more detailed block diagram illustrating components of the speaker virtualizer block of FIG. 4 under some embodiments. As shown in diagram 500 of FIG. 5, the speaker virtualizer block 502 contains a common speaker virtualizer 504 that takes as inputs the speaker feeds for immersive audio content as defined by the relevant surround-sound/immersive audio format. For the embodiment shown the input channels are Left (L), Right (R), Center (C), Left Surround (Ls), Right Surround (Rs), LFE, Left Height (Ltm) and Right Height (Rtm). These channel assignments are examples of a certain 7.1.2 immersive audio format, and other channels and nomenclatures are also possible. The virtualizer 504 outputs the desired 2.1.2 speaker feeds with the Left and Right channels sent directly to the left and right downward-firing speakers and the LFE, channel sent directly to the LFE speaker. The Left and Right height channels are processed in the crossover high-pass filter component 506, that passes signals above the cutoff (threshold) frequency to the upward-firing speakers. For the example embodiment of FIG. 5, the cutoff frequency is 2 kHz so left height channel audio above 2 kHz is sent to the left upward-firing speaker Ltm, and right height channel audio above 2 kHz is sent to the right upward-firing speaker Rtm. Left and right height channel audio below 2 kHz is mixed with the respective direct left and right audio content to be played back through the left and right speakers, respectively.

Figure 6:
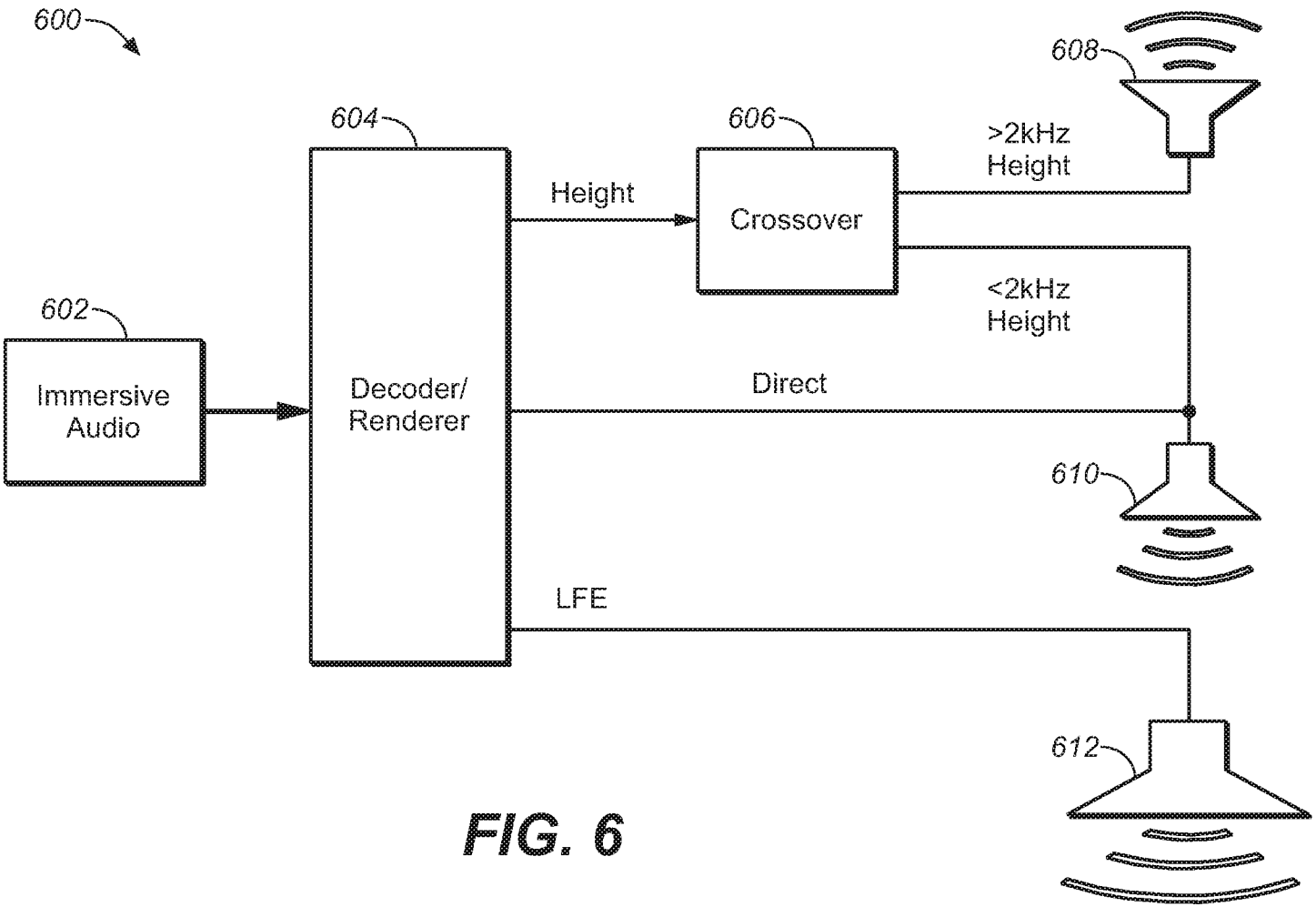
FIG. 6 is a general block diagram illustrating the main components of a portable device speaker system for rendering immersive audio content under some embodiments.

FIG. 6 is a general block diagram illustrating the main components of a portable device speaker system for rendering immersive audio content under some embodiments. FIG. 6 basically represents a generalized diagram 600 of the system of FIG. 5. System 600 starts with immersive audio content 602 being input to a decoder/renderer stage 604. The LFE and main audio signals are sent directly to the respective LFE, speaker 612 and left and right downward-firing drivers 610. The rendered height audio signals are input to crossover 606 which applies high pass filtering to send the height signals above the threshold frequency (e.g., 2 kHz) to the height speaker array (e.g., two or four speakers). The height signals below this frequency are mixed with the main signals for playback through the appropriate downward-firing drivers. The crossover component 606 is shown for purposes of illustration as a separate component, but it may be embodied as a function in any appropriate portion of the decoder/renderer block 604. Any parts of stages 604 and 606 may be provided as hardware components that are provided to a device manufacturer for integration into a product, such as through a chipset, dedicated circuit, etc., or as firmware such as in a device level program burned into a programmable array, ASIC (application specific integrated circuit), etc., or as software executed by a processor or co-processor of the device, or any combination of hardware/firmware/software.

Figure 7:
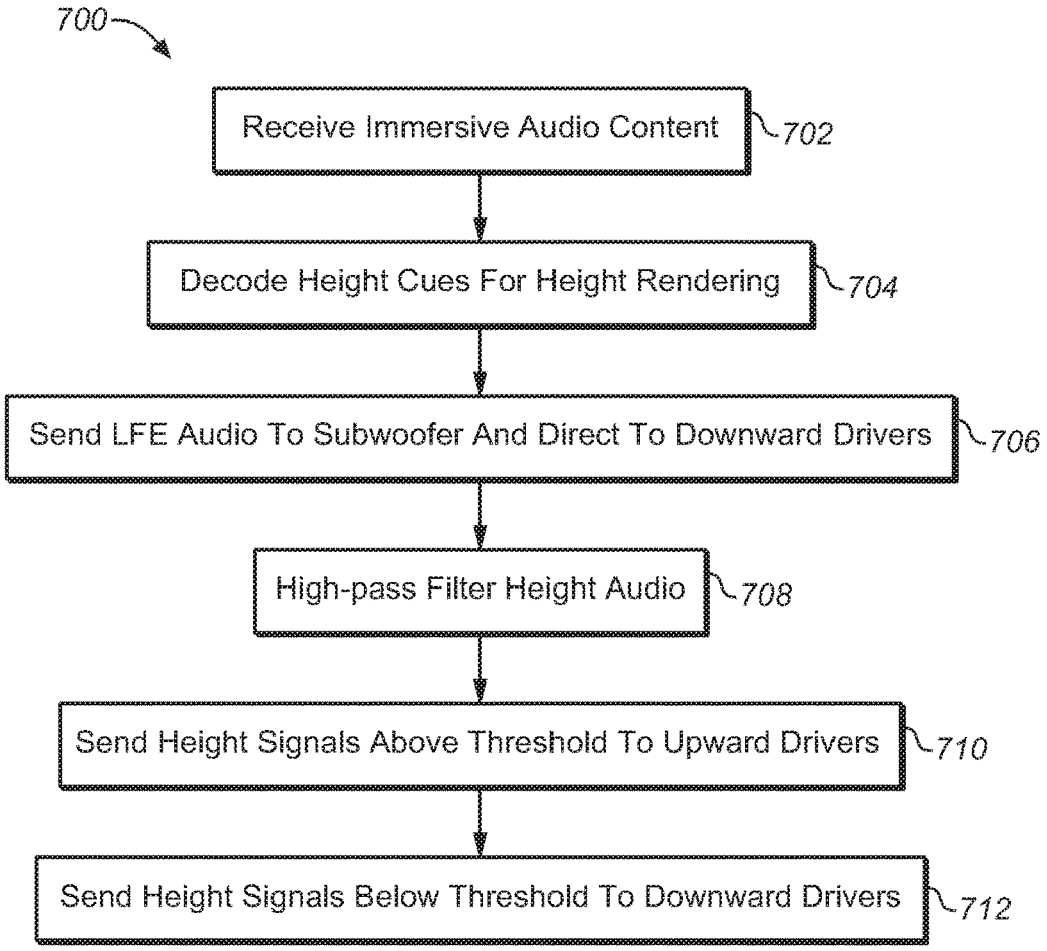
FIG. 7 is a flowchart that illustrates a method of rendering immersive audio content in a portable device under some embodiments.

FIG. 7 is a flowchart that illustrates a method of rendering immersive audio content through an upward-firing speaker system of a portable device under some embodiments. FIG. 7 also illustrates a method of creating a near-field audio experience for playback of immersive audio content through a portable device. Process 700 begins with a decoder stage of a portable device receiving immersive audio content, block 702. The decoder decodes the audio signals to generate the appropriate speaker feeds for the LFE, downward-firing (direct) and upward-firing (height) drivers, block 704. The LFE and direct audio signals are sent to the appropriate bottom side drivers, block 706, while the height signals are input to a crossover high-pass filter process, block 708. The height signals above the threshold frequency are sent to the upward-firing drivers, block 710, while the height signals below the threshold frequency are sent to the downward-firing drivers.

Figure 8A:
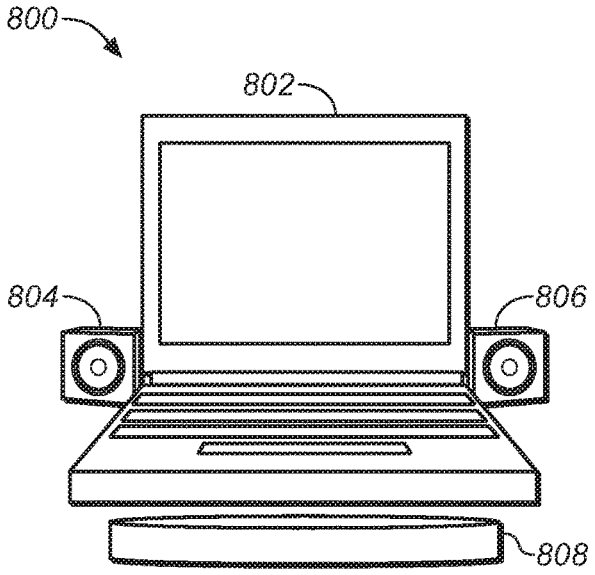
FIG. 8A is a diagram 800 that illustrates a portable device with external speakers for use with a near-field immersive audio rendering system, under an embodiment.

Embodiments have been described in relation to drivers that are internal to the portable device, through either drivers that are native to the device from initial manufacture or added to the device as part of an audio subsystem (hardware) upgrade to add upward-firing driver capability to the device. In an alternative embodiment, the portable device and audio subsystem (software stack) can be used in conjunction with external speakers that are close coupled to the device and that may be used to provide upward-firing capability. Such external speakers may be embodied in the form of small or miniature speaker units that plug directly or through a short cable into a speaker port of the device and/or a miniature soundbar that is directly or closely coupled to the device. FIG. 8A is a diagram 800 that illustrates a portable device with external speakers for use with a near-field immersive audio rendering system, under an embodiment. Computer 802 may have one or more internal speakers including downward-firing drivers for playback of direct or LFE audio. It also has one or more ports or connectors for coupling to external speakers. For near-field immersive effects, small speakers that are directly or closely coupled to the device are required so that the sound field is created as near to the user as possible, such as within the two-foot soundfield pattern. Such small speakers can be embodied in the form of small or miniature cube speakers 804, 806, or a soundbar 808 that can be placed in front of, behind, on top of, or even on the hinge area of the computer. These external speakers can be oriented so that they fire upward relative to the surface on which the computer sits, thus acting the same as the integrated upward-firing drivers 105 and 106 of FIG. 1. For this embodiment, the decoder/renderer stage may include a detector that detects the presence of external speakers that are configured to act as height speakers and to generate the appropriate speaker feeds for the height components.

Figure 8B:
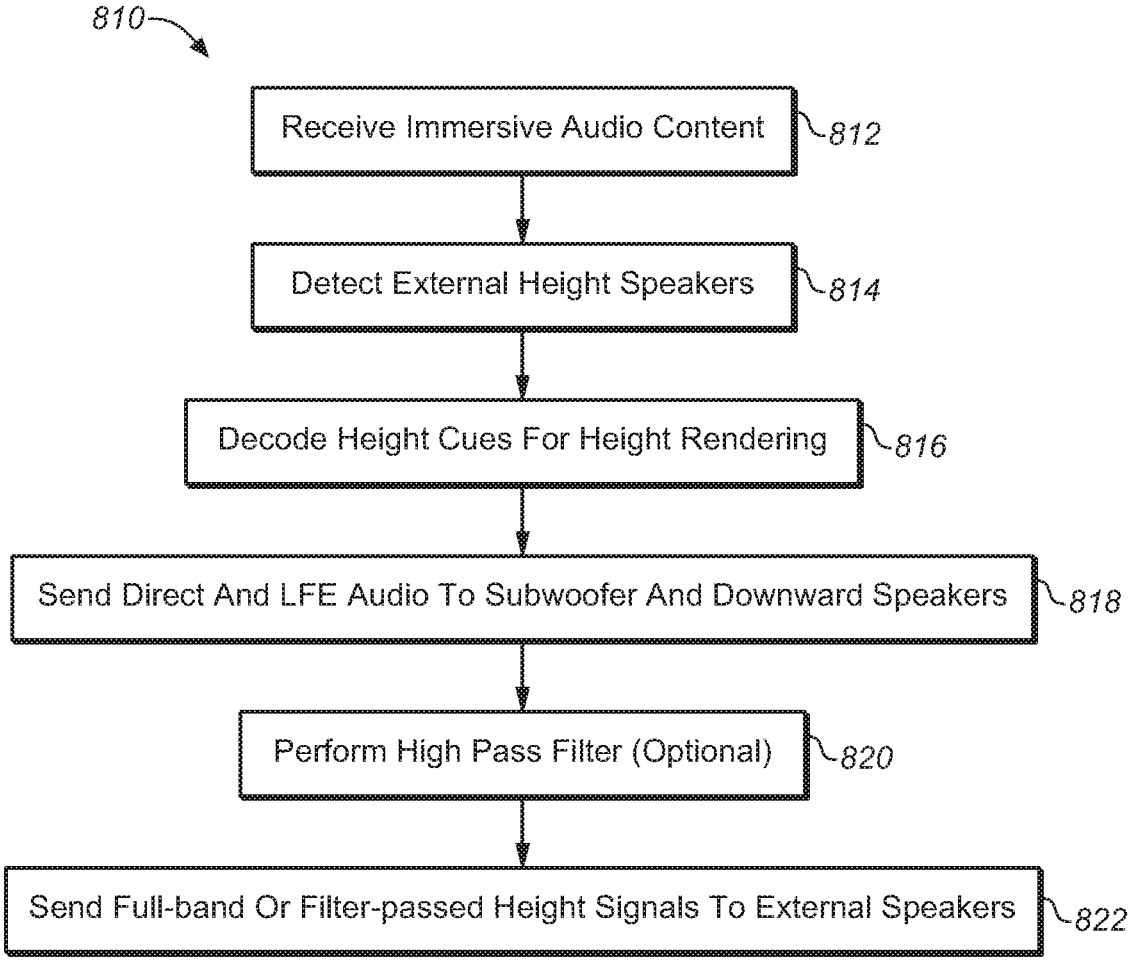
FIG. 8B is a flowchart that illustrates a method of rendering immersive audio content in a portable device under some alternative embodiments.

FIG. 8B is a flowchart that illustrates a method of rendering immersive audio content through an external upward-firing speaker system of a portable device this alternative embodiment. Process 800 begins with the decoder receiving the immersive audio content, block 812. The decoder detects the presence of any externally connected height speakers block 814, such as by monitoring electrical characteristics of the speaker ports or receiving configuration information input to the audio subsystem by the user. The decoder then decodes the height cues in the immersive audio bitstream for height rendering, block 816. The LFE and direct audio signals are sent directly to the internal downward-firing speakers, or alternatively any external direct firing speakers, block 818. If the external speakers are sufficiently large enough to handle the full range of height audio, all the decoded height signals can be sent to the external height speakers, block 822. Optionally, the crossover high-pass filter may be applied (block 820) to the height speakers to send only height signals above the threshold to the external speakers, block 822.

Figure 9:
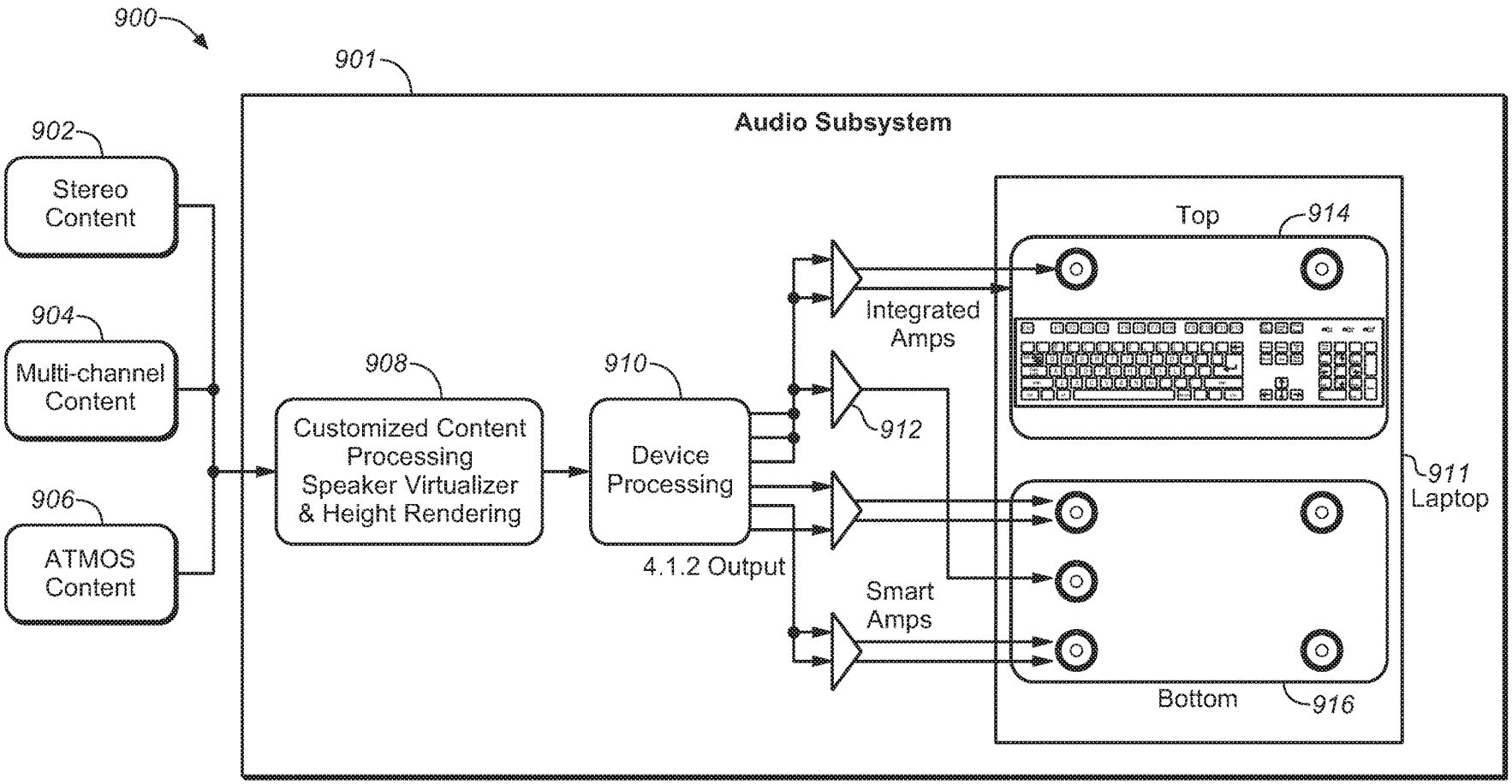
FIG. 9 illustrates an example use case and configuration for a portable device having integrated upward-firing drivers under an embodiment.

In an embodiment, renderer/decoder FIG. 4 comprises a component for facilitating playback of A/V content in the personal device; as such, it primarily performs audio decoding and processing of various types of content, such as surround sound processing, Dolby Pro Logic™ processing, Dolby Digital™ processing, Dolby TrueHD™ processing, and immersive content (Dolby Atmos). The hardware and software components of the audio subsystem for implementing upward-firing driver rendering of immersive audio may be used in a variety of different portable devices, and for a variety of different audio content. FIG. 9 illustrates a portable device that may represent a portable gaming computer or console as an example application. For system 900, various types of content including regular stereo audio content 902, multi-channel (e.g., surround-sound) content 904 and immersive audio (Atmos) content 906 are provided for input and playback through system 901 and the speakers of laptop 911. The input audio is processed in a customized content processing module 908, which may include a speaker virtualizer and height rendering process, as well as other functions. This block also includes the crossover high-pass filter functions described above. The rendered speaker feed signals are then input to the device processing component 910, which may include certain audio processing functions, such as EQ, gain control, shaping, filtering, and so on. The audio subsystem also includes an amplifier stage 912 that provides certain amplifiers such as integrated and smart amps to drive the rendered audio signal speaker feeds to the appropriate upward and downward-firing speakers of laptop 911. For the embodiment of FIG. 9, the laptop 911 comprises a top portion with the upward-firing drivers in a top surface proximate the hinge or screen, and a bottom portion housing the downward-firing drivers. The configuration of the laptop and configuration of speakers of laptop 911 correspond to computer 100 shown in FIG. 1, but embodiments are not so limited, and any other appropriate type or configuration of portable device may also be used.

Embodiments are directed to a novel audio subsystem that integrates upward-firing speakers and audio post-processing technologies will allow portable devices to render and play immersive audio content, such as Dolby Atmos content (encoded in DD+/JOC format) and simulate the height content in the near field for the listener. The embodiments described herein allow portable computer and audio playback devices to render newer audio formats, such as the object-based Dolby Atmos system. Though such systems traditionally may introduce additional speakers, such as height speakers or reflected sound speakers that provide immersive sound by projecting sound based on height cues in the audio program. The internal device speakers provide a near-field audio experience that allows these portable devices to recreate at least some of the height cues that are rendered in much larger immersive audio environments.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," and "hereunder" and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A speaker system for a portable computing device comprising:

an array of drivers projecting sound upwards from a top surface of the portable computing device to form upward-firing speakers for playback of height audio signals;

a set of speakers mounted on a bottom underside surface of the portable computing device and including at least two stereo speakers projecting sound downwards from a bottom surface of the portable computing device to form downward-firing speakers for playback of direct audio signals;

a decoder/renderer component within an operating system of the portable computing device receiving immersive audio content comprising channel-based audio and object-based audio including sound objects having height components, decoding the height audio signals from the content into high-frequency height signals and low-frequency height signals to form decoded audio to be sent appropriately to the downward-firing speakers and the upward-firing speakers, wherein the downward-firing and upward-firing speakers are selected for and positioned in the portable computing device in a defined speaker configuration tailored specifically for a product model of the portable computing device;

an audio subsystem driver comprising a software processing block implemented as a Stream Effect Audio Processing Object (SFX APO) accessed by one or more software libraries implementing audio post-processing software utilizing the defined speaker configuration, and having a speaker virtualizer, a content processing block, and a device processing block, wherein the speaker virtualizer virtualizes the decoded audio to transmit respective audio signals through the device processing block to correct speakers of the upward-firing speakers and downward-firing speakers;

a crossover of the content processing block having a threshold frequency separating the high-frequency height signals from low-frequency height signals, performing a high-pass filter function to pass the high frequency height signals to the upward-firing speakers and the low frequency height signals and the direct audio signals to the downward-firing speakers; and the audio subsystem driver using the defined speaker configuration and filter function with the audio post-processing software to simulate a sound field above and around the portable computing device in a near-field distance on the order of two feet around the portable computing device for a user positioned proximate the portable computing device for playback of the immersive audio content, wherein the upward-firing speakers and the audio subsystem driver are configured to form the sound field above the portable computing device from only upward projected sound signals transmitted from the upward-firing speakers and without utilizing sound reflection from a ceiling or upper surface of a listening environment.

2. The speaker system of claim 1 wherein the sound from the upward firing speakers is projected in a sound pattern directed 90 degrees up from the top surface of the portable computing device when a lid of the portable computing device is opened 90 degrees or more from the top surface, and wherein the upward firing speakers are placed in a position of the upper surface proximate a display screen of the portable computing device when the display screen is deployed for viewing by the user to improve reproduction of height cues in the height audio signals.

3. The speaker system of claim 1 wherein the array of drivers comprises one of: a pair of stereo drivers or a set of four equidistantly spaced drivers, and wherein the set of downward-firing speakers comprises a low frequency effect (LFE) driver, and further wherein the array of drivers and set of speakers is configured in a 2.1.2 format with the 0.1 component for the LFE driver and the 0.2 designation for two height channel speakers.

4. The speaker system of claim 1 wherein each driver of the array of drivers comprises a transducer of approximately 15 mm to 20 mm in diameter and 4 mm to 6 mm thickness placed into an enclosure of approximately 3 cc to 4 cc in volume.

5. The speaker system of claim 1 wherein the threshold frequency is 2 kHz.

6. The speaker system of claim 1 wherein the portable computing device is a device selected from the group consisting of: laptop computer, tablet computer, game console, smart phone, and portable audio playback device.

7. The system of claim 1, further comprising a device post-processing block including the device processing block and integrated as an Endpoint Effect Audio Processing Object (EFX APO) to regulate the upward-firing speakers and downward-firing speakers through at least one of audio equalization, filtering, and high pass/low pass functions.

8. The system of claim 7 wherein the immersive audio content comprises audio content encoded in Dolby Digital Plus/Joint Object Coding (DD+/JOC) format.

9. A method of creating a near-field sound environment for playback of immersive audio content through a portable computing device, comprising:

providing an array of drivers projecting sound upwards from a top surface of the portable computing device to form upward-firing speakers for playback of height audio signals, and a set of speakers mounted on a bottom underside surface of the portable computing device and including at least two stereo speakers projecting sound downwards from a bottom surface of the portable computing device to form downward-firing speakers for playback of direct audio signals;

receiving immersive audio content within a decoder/renderer component within an operating system of the portable computing device, the immersive audio content comprising channel-based audio and object-based audio including sound objects having height components;

decoding the received immersive audio content to separate direct audio from height audio to generate appropriate direct and height speaker feeds, and further decoding the height audio into high-frequency height signals and low-frequency height signals to form decoded audio to be sent appropriately to the downward-firing speakers and the upward-firing speakers, wherein the downward-firing and upward-firing speakers are selected for and positioned in the portable computing device in a defined speaker configuration tailored specifically for a product model of the portable computing device;

virtualizing, in an audio subsystem driver having a speaker virtualizer comprising a software processing block implemented as a Stream Effect Audio Processing Object (SFX APO) accessed by one or more software libraries implementing audio post-processing software utilizing the defined speaker configuration, a content processing block, and a device processing block, the decoded immersive audio content to transmit respective audio signals through the device processing block to correct speakers of the upward-firing speakers and downward-firing speakers;

transmitting the direct audio to direct speakers of the portable computing device through the direct speaker feeds;

high-pass filtering, in a crossover of the content processing block having a threshold frequency separating the high-frequency height signals from low-frequency height signals, the height audio to pass the high-frequency height signals to the height speakers of the portable computing device and to pass the direct audio signals low-frequency height signals to the downward-firing speakers; and using the defined speaker configuration and filter function with the audio post-processing software to simulate a sound field above and around the portable computing device in a near-field distance on the order of two feet around the portable computing device for a user positioned proximate the portable computing device for playback of the immersive audio content, wherein the upward-firing speakers and the audio subsystem driver are configured to form the sound field above the portable computing device from only upward projected sound signals transmitted from the upward-firing speakers and without utilizing sound reflection from a ceiling or upper surface of a listening environment.

10. The method of claim 9 wherein the threshold frequency is 2 KHz, and wherein the upward firing speakers are placed in a position of the upper surface proximate a display screen of the portable computing device when the display screen is deployed for viewing by the user to improve reproduction of height cues in the height audio signals, and further wherein the sound from the upward firing speakers is projected in a sound pattern directed 90 degrees up from the top surface of the portable computing device when a lid of the portable computing device is opened 90 degrees or more from the top surface.

11. The method of claim 9 wherein the direct speaker feeds comprise left, right, and low frequency effects (LFE) channel feeds, and the height speaker feeds comprise right and left height channels, wherein each height channel drives at least one or a pair of individual upward-firing drivers of a speaker array, and further wherein the array of drivers and set of speakers is configured in a 2.1.2 format with the 0.1 component for the LFE driver and the 0.2 designation for two height channel speakers.

12. The method of claim 9 further comprising providing a device post-processing block including the device processing block and integrated as an Endpoint Effect Audio Processing Object (EFX APO) to regulate the upward-firing speakers and downward-firing speakers through at least one of equalization, filtering, and shaping of the immersive audio content.

13. The method of claim 12 wherein the portable computing device is a device selected from the group consisting of: laptop computer, tablet computer, game console, smart phone, and portable audio playback device, and wherein the immersive audio content comprises audio content encoded in Dolby Digital Plus/Joint Object Coding (DD+/JOC) format.

14. The method of claim 9 further comprising:

detecting the presence of one or more external speakers for playback of the height audio; and transmitting the height speaker feeds to the detected external speakers.

* * * * *